United States Patent [19]

Kubozuka

[11] 4,446,827

[45] May 8, 1984

[54] CYLINDER BLOCK OF INTERNAL COMBUSTION ENGINE

[75] Inventor: Takao Kubozuka, Yokosuka, Japan

[73] Assignee: Nissan Motor Co., Ltd., Yokohama, Japan

[21] Appl. No.: 273,727

[22] Filed: Jun. 15, 1981

[30] Foreign Application Priority Data

Jun. 21, 1980 [JP] Japan ..... 55-87332[U]

[51] Int. Cl.[3] ..... F02F 1/10

[52] U.S. Cl. ..... 123/195 R; 123/41.84; 123/193 C; 123/195 C

[58] Field of Search ..... 123/195 R, 41.83, 41.84, 123/193 R, 193 C, 195 C; 181/204

[56] References Cited

U.S. PATENT DOCUMENTS

| | | | |
|---|---|---|---|
| 2,199,423 | 5/1940 | Taylor | 123/195 R |
| 3,540,425 | 11/1970 | Scheiterlein et al. | 123/195 R |
| 3,698,370 | 10/1972 | Haldeman et al. | 123/193 C |
| 3,853,099 | 12/1974 | Feather et al. | 123/41.84 |
| 3,996,913 | 12/1976 | Hamparian | 123/41.83 |

FOREIGN PATENT DOCUMENTS

| | | |
|---|---|---|
| 0177289 | 6/1953 | Fed. Rep. of Germany . |
| 1997550 | 11/1968 | Fed. Rep. of Germany . |
| 1751919 | 7/1971 | Fed. Rep. of Germany . |
| 2908735 | 9/1980 | Fed. Rep. of Germany . |
| 0428319 | 7/1967 | Switzerland . |

OTHER PUBLICATIONS

Ishihama et al., "An Analysis of the Movement of the Crankshaft Journals During Engine Firing", SAE Technical Paper 810772, Jun. 8, 1981, pp. 1–12.

*Primary Examiner*—Craig R. Feinberg

*Attorney, Agent, or Firm*—Schwartz, Jeffery, Schwaab, Mack, Blumenthal & Koch

[57] ABSTRACT

A cylinder block of an internal combustion engine, comprises an integrally formed metallic main body including a cylinder section and bearing bulks and a part of a water jacket. First and second side cover members are secured respectively to the opposite side surfaces of the main body so as to maintain a fluid-tight seal therebetween, each side cover member defining thereinside a part of said water jacket and including a skirt section. The side cover members are made of a non-metallic material which is light in weight and high in damping capacity, thereby effectively damping the engine vibration transmitted to the side cover members to prevent the skirt section of the side cover members from emitting noise.

7 Claims, 6 Drawing Figures

CYLINDER BLOCK OF INTERNAL COMBUSTION ENGINE

BACKGROUND OF THE INVENTION

This invention relates to an improvement in a cylinder block of an internal combustion engine to decrease emission of engine noise and to achieve reduction in weight of the cylinder block.

Most cylinder blocks of conventional internal combustion engines are integrally formed with a skirt section located at the lower part thereof. The skirt section is usually secured connected to an oil pan and defines thereinside a crankcase. Although this skirt section contributes to an increase in rigidity of the cylinder block, the skirt section itself vibrates considerably due to vibration resulting from combustion in the engine cylinders, thereby producing considerable noise from the skirt section surface. In other words, the skirt section serves as a secondary noise source.

BRIEF SUMMARY OF THE INVENTION

In accordance with the present invention, a cylinder block of an internal combustion engine, comprises an integrally formed metallic main body including a cylinder section which forms therein engine cylinders, a part of a water jacket being formed around the cylinder section. The cylinder block further comprises first and second side cover members secured to the opposite side surfaces of the main body so as to maintain a fluid-tight seal therebetween, each side cover member including a water jacket outer wall section defining thereinside a part of the water jacket, and a skirt section defining thereinside a crankcase, the first and second side cover members being made of a non-metallic material which is light in weight and high in damping capacity. With this cylinder block structure, the vibration transmitted to the side cover members can be effectively damped and therefore the skirt sections of the side cover members are prevented from vibration, thereby preventing noise emission from the skirt section of the cylinder block. Additionally, this cylinder block structure greatly contributes to a reduction in weight of the engine, which leads to fuel economy.

BRIEF DESCRIPTION OF THE DRAWINGS

The features and advantages of the cylinder block according to the present invention will be more clearly appreciated from the following description taken in conjunction with the accompanying drawings in which like reference numerals designate like part and elements, and in which.

DETAILED DESCRIPTION OF THE INVENTION

Figure 1:
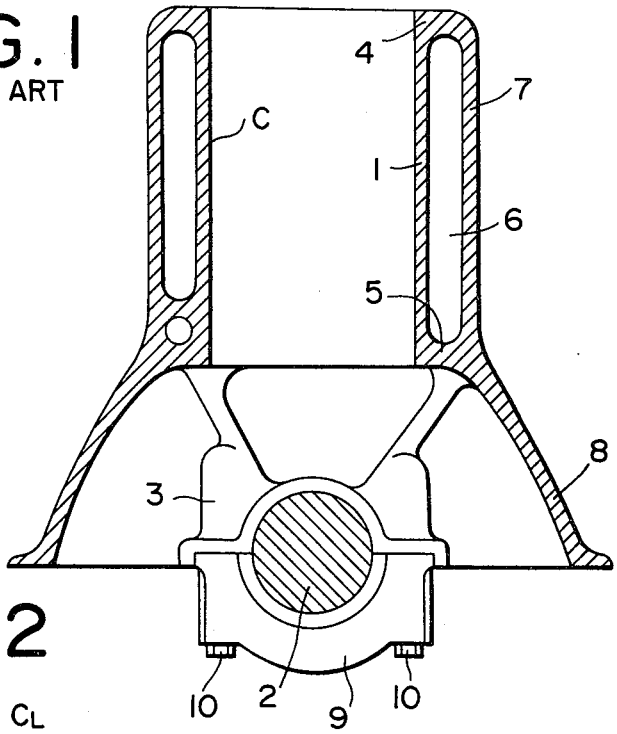
FIG. 1 PRIOR ART
FIG. 1 is a vertical section view of a conventional cylinder block structure of an internal combustion engine.

To facilitate understanding the present invention, a brief reference will be made to a conventional cylinder block, depicted in FIG. 1. Referring to FIG. 1, a conventional cylinder block is formed with a plurality of bearing bulks 3 which are aligned along the axial direction of a crankshaft 2 and located below a cylinder section 1 defining therein engine cylinders C. The cylinder section 1 is formed integrally with a water jacket outer wall section 7 together with upper and lower deck sections 4, 5, defining a water jacket 6 among them. A cylinder block skirt section 8 is also formed integrally with the water jacket outer wall section 7 and defines thereinside a crankcase. Each main bearing cap 9 is secured to the corresponding bearing bulk 3 using bolts 10 so as to rotatably support the crankshaft 2. The skirt section 8 functions to prevent the free vibration of each bearing bulk and whole bearing bulks vibration which leads to collapse thereof, and contributes to improvements in tortional rigidity of the cylinder block and flexural rigidity in the axial direction of the same.

However, such a conventional cylinder block has encountered the following problems: Although the skirt section 8 is formed with some boss portions and ribs (not shown), the skirt section is generally formed into the shape like a single plate. Accordingly, the skirt section 8 itself vibrates in receiving a considerable force from the bearing bulks 3, thereby generating medium and high frequency noises and emitting them. Furthermore, since the water jacket outer wall section 7 is integrally formed with the engine cylinder section 1, vibration of the cylinder section 1 due to combustion impact or pressure is liable to be transmitted to the outer wall section 7, so that a large amount of noise is emitted from the water jacket outer wall section 7. Moreover, the conventional cylinder block is formed of a metallic material except for the bearing caps 9, and thus, the weight of the cylinder block necessarily becomes heavier.

Figure 2:
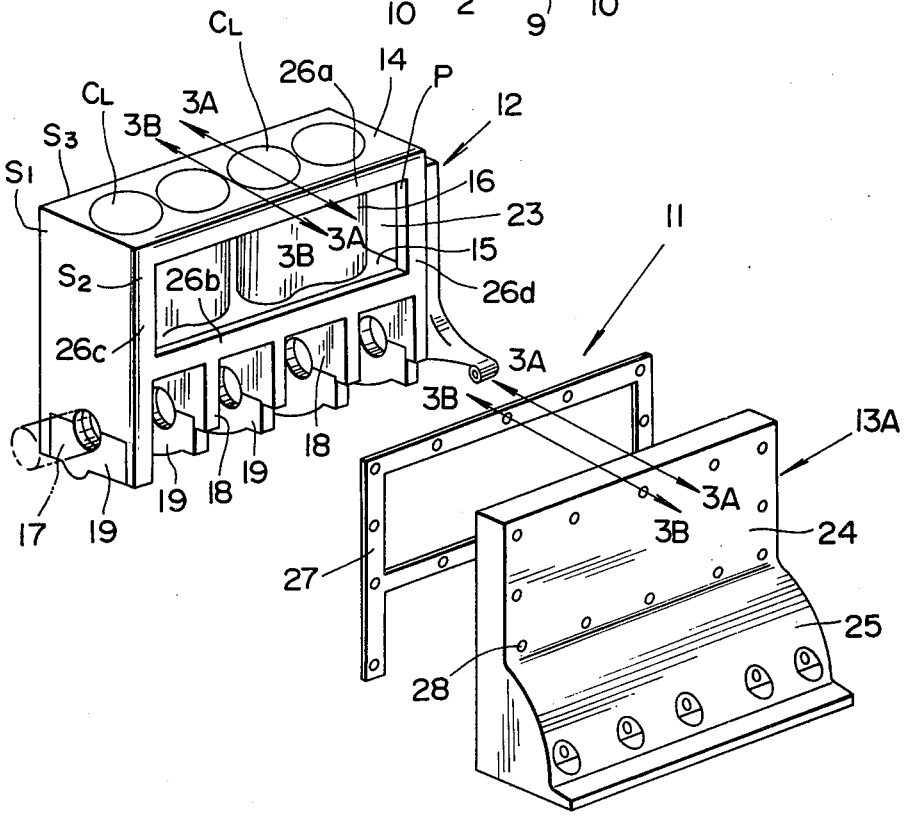
FIG. 2 is an exploded perspective view of an embodiment of a cylinder block of an internal combustion engine, in accordance with the present invention.
Figure 3A:
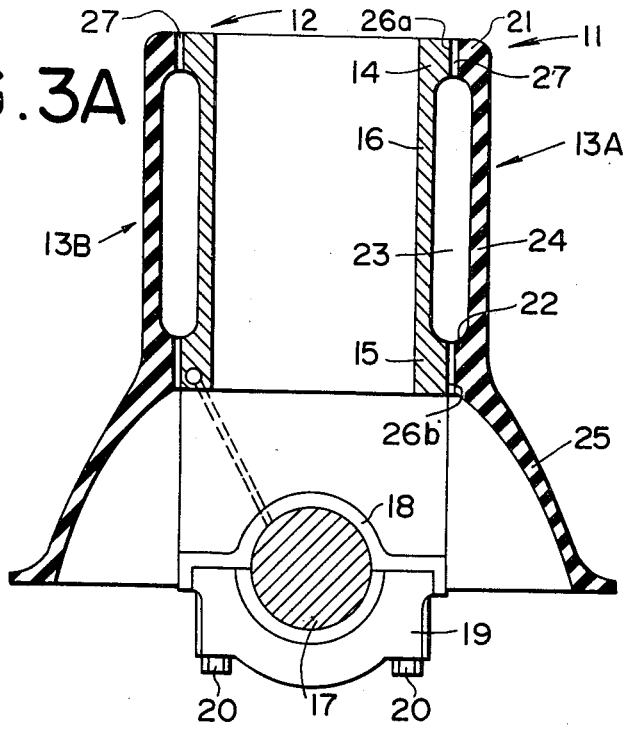
FIG. 3A is a vertical sectional view taken substantially along the line 3A—3A of FIG. 2.
Figure 3B:
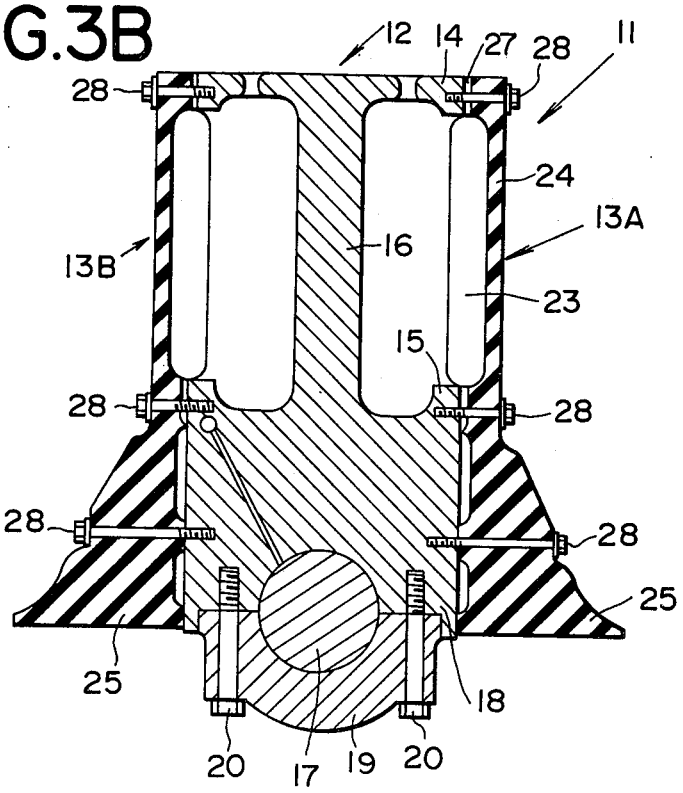
FIG. 3B is a vertical section view taken substantially along the line 3B—3B of FIG. 2.

In view of the above description of the conventional cylinder block arrangement, reference is now made to FIGS. 2 to 5, and more specifically to FIGS. 2, 3A and 3B, wherein a preferred embodiment of the cylinder block of the present invention is illustrated by the reference numeral 11. The cylinder block 11 is of an internal combustion engine which is, for example, used for an automotive vehicle. The cylinder block 11 comprises a cylinder block main body 12 which is made of a metallic material or an alloy and integrally formed as a single piece to obtain a sufficiently high mechanical strength. The cylinder block main body 12 is generally in the shape of a rectangular parallelpiped and includes an engine cylinder section 16 which is formed therein with a plurality of engine cylinders $C_L$. Upper and lower deck sections 14, 15 are integrally formed with the upper and lower portion of the cylinder section 16, respectively. As shown, the upper and lower deck sections 14, 15 are parallel with each other and also parallel with the axis of a crankshaft 17.

A plurality of bearing bulks 18 are formed integrally with the lower portion of the cylinder section 16 and extend downward and parallelly with a vertical end surface $S_1$ of the cylinder block main body 12. The bearing bulks 18 are aligned along the axial direction of the crankshaft 17 which is rotatably supported by the bearing bulks 18 and main bearing caps 19 each of which is secured to each bearing bulk 18 using bolts 20. As shown, a water jacket 23 or engine coolant passage is formed around the cylinder sections 16, and the water jacket 23 is merged into the outside of the cylinder block main body 12 through two rectangular openings P which are formed through the opposite side surfaces $S_2$, $S_3$ of main body 12, respectively.

First and second side cover members 13A and 13B are provided to cover the opposite side surfaces $S_2$, $S_3$ of the cylinder block main body 12. Each side cover member 13A or 13B is integrally formed as a single piece and includes a water jacket outer wall section 24 defining thereinside a part of the water jacket 23, and a bulged skirt section 25 defining thereinside a crankcase. The water jacket outer wall section 24 is formed integrally with the upper and lower deck corresponding sections 21, 22 respectively at the upper and lower portions thereof. Each side cover member 13A or 13B is made of a material, which is relatively light in weight and relatively high in damping capacity, such as rubber, plastic, resin etc. The first side cover member 13A is securely attached through a gasket 27 to the side surface $S_2$ of the cylinder block main body 12 by a plurality of bolts 28, in which the sections 21, 22 of the side cover member 13A are fixed through the gasket 27 respectively to upper and lower attachment surfaces *26a*, *26b* of the cylinder block main body side surface $S_2$. The attachment surfaces *26a*, *26b* are formed, for example, by machinery cutting, to be smooth enough or to have a predetermined surface roughness so as to provide a water and oil tight seal. In this connection, the attachment surfaces *26a*, *26b* lie on a common plane. It will be understood that the cylinder block main body side surface $S_2$ is formed with two vertical attachment surfaces *26c*, *26d* which are integral with the upper and lower attachment surfaces *26a*, *26b* and lie on the same plane as the attachment surfaces *26a*, *26b*. It will be also understand that the first side cover member 13A is also formed with sections (not shown) which correspond to the main body attachment surfaces *26c*, *26d* and are integral with sections 21, 22 of the first side cover member 13A. Accordingly a part of the water jacket 23 is formed between the outer surface of the cylinder section 16 and the inner surface of the outer wall section 24 of the side cover member 13A. As shown, also the skirt section 25 of the side cover member 13A is securely attached to the bearing bulks 18 using bolts 28. It will be appreciated the second side cover member 13B is securely attached to the another side surface $S_3$ of the cylinder block main body 12 in the same manner as the first side cover member 13A, so that the side surface $S_3$ is formed with an opening (P) and attachment surfaces (*26a*,*26b*,*26c*,*26d*) like in the side surface $S_2$.

With the above-mentioned arrangement of the cylinder block 11, the cylinder block main body 12 including the cylinder section 16 and the bearing bulks 18 are formed of a metallic material and thus have sufficient strength to permit same to be subjected to severe external forces. Additionally, since the side cover member 13A, 13B for covering the side surfaces of the cylinder block main body 12 is formed of a high damping capacity material, the vibration transmitted to the side cover members 13A, 13B can be effectively damped so that the surfaces of the side cover members 13A, 13B are prevented from vibrating, thereby preventing emission of medium and high frequency noises. Furthermore, the cylinder block 11 is sufficient high in water and oil tight sealing ability because the side cover member attachment surfaces *26a*, *26b* of the cylinder block main body 12 have the predetermined low surface roughness and lie on the same plane as discussed above. In order to further prevent vibration of the side cover members 13A, 13B, it is preferable to use a gasket made of a material containing rubber, in place of the gaskets 27, and use a vibration damping washer for each bolt 28, which washer is formed of a material containing rubber and reinforced by a steel plate.

Figure 4:
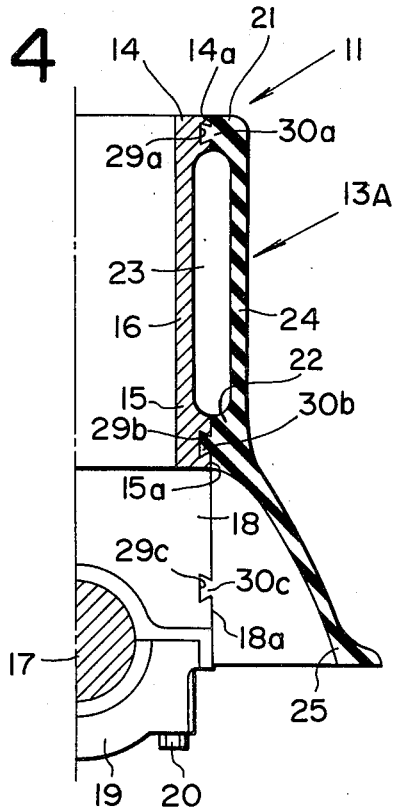
FIG. 4 is a partial section view similar to FIG. 3A, but showing another embodiment of the cylinder block in accordance with the present invention.
Figure 5:
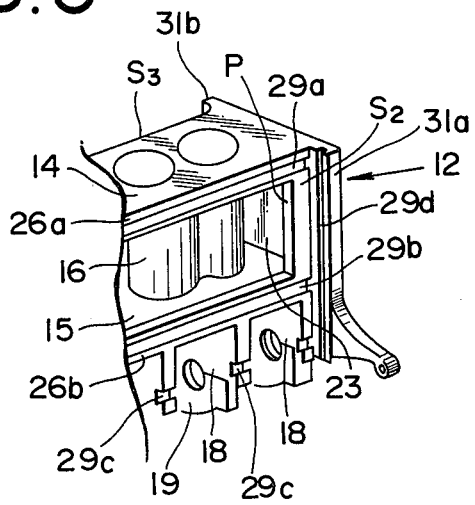
FIG. 5 is a partial perspective view similar to FIG. 2, but showing a cylinder block main body of FIG. 4.

FIGS. 4 and 5 illustrate another embodiment of the cylinder block 11 according to the present invention, which is similar to the embodiment of FIGS. 2, 3A, and 3B with the exception that a gasket is not used for attaching the side cover members to the cylinder block main body 12. As shown, the attachment surfaces *26a*, *26b* of the main body upper and lower deck sections 14, 15 are formed with respective grooves *29a*, *29b* which are generally horizontal and parallel with each other. Additionally, a series of grooves *29c* are formed at the respective side surfaces of the bearing bulks 18, which grooves *29c* are aligned parallel with the grooves *29a*, *29b*. In this instance, the cylinder block main body 12 is formed integrally with a pair of opposite vertically elongated sections *31a*, *31b* each of which has a vertical groove *29d*. In this connection, the side cover member 13A is formed at its sections 21, 22 and skirt section 25 with respective elongate projections *30a*, *30b*, *30c* which are parallel with each other and engageable with the grooves *29a*, *29b*, *29c*, respectively.

In order to assemble the cylinder block of FIG. 4, the elongate projections *30a*, *30b*, *30c* are first put respectively into the grooves *29a*, *29b*, *29c* at the fore end of the main body 12, and next the side cover member 13A is pushed toward the aft end of the main body 12, in which a vertically elongated section of the side cover member 13A is engaged with the groove *29d* of the vertically elongated section of the main body aft end. Thus, the assembly of the cylinder block 11 is completed without using the gasket. It is preferable to apply an adhesive within the grooves *29a* to *29b* in order to secure a sealing ability of the cylinder block 11. It will be appreciated that, in this embodiment the counterpart second side cover member 13B (not shown) is securely attached to the opposite side surface $S_3$ of the main body 12 in the same manner as the first said cover membe 13A.

As appreciated from the above, according to the present invention, the cylinder block main body is integrally formed as a single piece and made of a metallic material, whereas each side cover member including the water jacket outer wall section and skirt section is made of a light and high damping capacity material such as plastic or hard rubber. This can provide a sufficient mechanical strength to the cylinder block and achieve engine noise reduction by preventing medium and high frequency noise from being emitted from the skirt section of the cylinder block, and further enable a reduction in weight of the assembled cylinder block.

What is claimed is:

1. A cylinder block of an internal combustion engine, comprising:

an integrally formed metallic main body including a cylinder section which forms therein engine cylinders, and bearing bulks, a part of a water jacket being formed around said cylinder section; and first and second side cover members secured respectively to the opposite side surfaces of said main body so as to maintain a fluid-tight seal therebetween, each side cover member including a water jacket outer wall section defining thereinside a part of said water jacket, and a skirt section defining thereinside a crankcase and securely connected to said bearing bulks, said skirt section being integral with said water jacket outer wall section, and said first and second side cover members being made substantially entirely of a non-metallic material which is light in weight and high in vibration damping capacity.

2. A cylinder block as claimed in claim 1, wherein said non-metallic material is one selected from the group consisting of rubber, plastic, and resin.

3. A cylinder block as claimed in claim 1, wherein said main body is generally of the shape of a rectangular parallelpiped and formed with first and second opposite openings located at the opposite side surfaces thereof, said first and second openings forming part of said water jacket, and attachment surfaces located around said first and second openings, said first and second side cover members being fixed respectively to said first and second attachment surfaces, main body including a plurality of bearing bulks located under said cylinder section to rotatably support a crankshaft.

4. A cylinder block as claimed in claim 3, wherein said water jacket outer wall section is securely attached to said attachment surface of the main body side surface, and said skirt section is securely attached to side surfaces of said bearing bulks.

5. A cylinder block as claimed in claim 4, wherein each attachment surface lie on a common plane.

6. A cylinder block as claimed in claim 4, further comprising first and second gaskets each of which is located between each attachment surface of said main body and the surface of said water jacket outer wall section of each side cover member.

7. A cylinder block as claimed in claim 4, wherein each attachment surface of said main body is formed with two parallel grooves which elongate parallelly with the axis of said crankshaft, and said water jacket outer wall section of each side cover member is formed with two parallel projections which are securely engageable respectively with said two parallel grooves of said main body.

* * * * *